United States Patent [19]

Grable

[11] Patent Number: 4,497,519

[45] Date of Patent: Feb. 5, 1985

[54] METAL PARTICLE RECOVERY AT SUB-SURFACE LOCATIONS

[76] Inventor: Donovan B. Grable, Rte. 8 - Box 317, Caldwell, Id. 83605

[21] Appl. No.: 443,534

[22] Filed: Nov. 22, 1982

[51] Int. Cl.[3] ..... E02F 7/00

[52] U.S. Cl. ..... 299/8; 299/9; 37/63

[58] Field of Search ..... 299/8, 9; 37/62, 63

[56] References Cited

U.S. PATENT DOCUMENTS

| | | | |
|---|---|---|---|
| 168,278 | 9/1875 | Newton | 37/63 |
| 656,994 | 8/1900 | Munn | 37/63 |
| 1,533,465 | 4/1925 | Rowe | 37/63 |
| 2,144,743 | 1/1939 | Schulz | 37/62 X |
| 2,605,090 | 7/1952 | Jacobson | 299/8 |
| 2,956,354 | 10/1960 | Varner | 37/63 |
| 2,960,368 | 11/1960 | Watanabe | 37/63 X |
| 3,790,213 | 2/1974 | Grable | 299/8 |
| 3,855,807 | 12/1974 | Grable | 37/73 X |
| 3,856,355 | 12/1974 | Grable | 299/8 |
| 3,917,326 | 11/1975 | Grable | 299/8 |
| 3,964,184 | 6/1976 | Mathieu | 37/63 X |

FOREIGN PATENT DOCUMENTS

| | | | |
|---|---|---|---|
| 234395 | 5/1960 | Australia | 37/63 |

*Primary Examiner*—Stephen J. Novosad
*Assistant Examiner*—Mark J. DelSignore
*Attorney, Agent, or Firm*—William W. Haefliger

[57] ABSTRACT

Apparatus for recovering metallic particles in a sub-surface formation includes first and second ducts that extend downwardly, the first duct discharging water in a pressurized stream to effect differential elevation of particles in a turbulant water zone. The second duct has an intake positioned for drawing water and particles into the second duct from that zone. A loose flexible connection interconnects the two ducts to accommodate second duct movement up and down and laterally relative to the first duct. Also provided is means to adjust the position of the second duct intake relative to the discharge of the first duct, and a carrier vehicle movable over terrain and water and suspending the two ducts.

8 Claims, 5 Drawing Figures

24
22
23
20
19
21
15a
~10~
17a
18a
26
15
27
~11~
21a
25
~16a~
17b
18b
~12~
~18~
15c
17c
~16~
~13~
14

METAL PARTICLE RECOVERY AT SUB-SURFACE LOCATIONS

BACKGROUND OF THE INVENTION

This invention relates generally to the recovery of metallic particles at sub-surface localities, and more particularly concerns methods and apparatus for effecting such recovery without removal of the overburden and without mining activity carried out by humans at underground levels.

Mining operations over large areas of the world have involved stripping the overburden off bedrock underlying streams where gold and/or other precious metal particles were concentrated. Typically, intermixed soil and rocks were redeposited over the bedrock after dredging of the gold bearing layers; however, the bucket type dredging equipment that was conventionally employed could not reach much of the gold or metal particles, as for example larger particles that were trapped in cracks and crevices in the bedrock. Where ore recovery beneath the sea was conducted, ocean floor "sweeping operations" to recover loose particles and grannules did not contemplate recovery of inaccessible or trapped materials. No way was known, to my knowledge to accomplish recovery of such trapped precious metal particles, or other weight segregatable particles, in the simple manner as now afforded by the present invention. As to the latter, the invention is especially useful in that particle recovery may now be carried out beneath undisturbed land, without requiring stripping of the overburden off the bedrock.

Relevant patents are my U.S. Pat. Nos. 3,790,213 3,855,807; 3,856,355; and 3,917,326.

SUMMARY OF THE INVENTION

It is a major object of the invention to provide further solutions to the above problems which will enable enhanced precious and other metal or heavy particle recovery at remote sub-surface locations, i.e., beneath the land or water body surface level.

The method of the invention basically involves use of a first duct having a discharge and a second and separate duct having an intake, the steps including:

(a) delivering water in a pressurized stream to said locality via the first duct discharge to effect differential elevation of metallic and non-metallic particles in a turbulent water zone associated with the discharge, (b) and positioning the intake of the second duct for drawing water and metallic particles from said zone into the second duct.

Further, the intake is typically adjustably located at an elevation at which the metallic fines tend to concentrate in the turbulent water zone typically formed in a bell hole, as will be disclosed. Accordingly, the method may with unusual advantage include allowing the first duct to penetrate downwardly into the formation while hydraulically forming a pit therein and maintaining a loose connection between the lower portions of the ducts so that the intake of the second duct is captivated to remain at an adjustable position within a predetermined zone associated with the discharge end of the first duct, within the pit.

The apparatus employed typically includes:

(a) a first duct having a discharge and operable to deliver water in a pressurized stream to said locality via said discharge for effecting differential elevation of metallic and non-metallic particles in a turbulent water zone associated with said discharge, and (b) a second duct having an intake positioned in said zone for drawing water and metallic particles from said zone into said second duct.

These and other objects and advantages of the invention, as well as the details of an illustrative embodiment, will be more fully understood from the following specification and drawings, in which:

DRAWING DESCRIPTION

Figure 2:
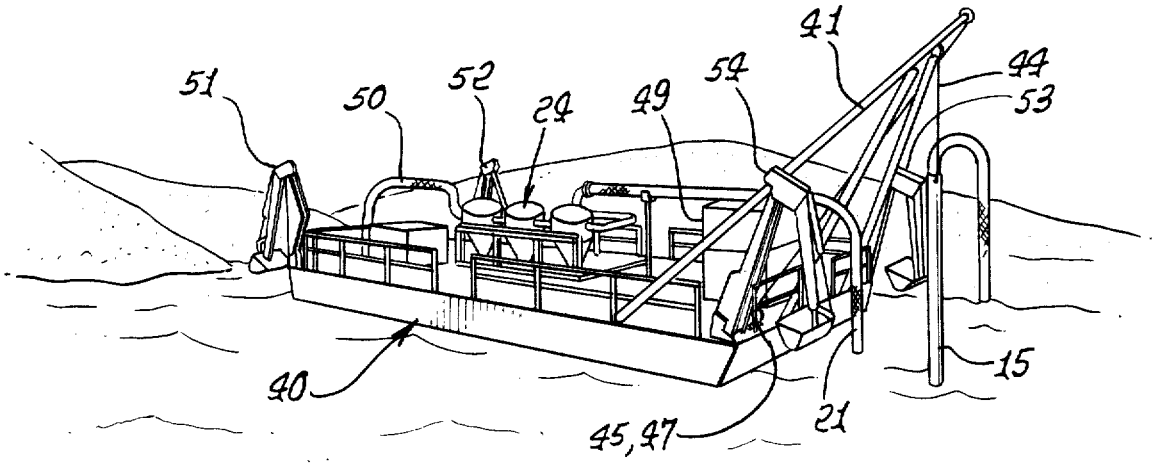
FIG. 2 is a perspective view of a carrier vehicle associated with water delivering and sucting ducts.
Figure 2A:
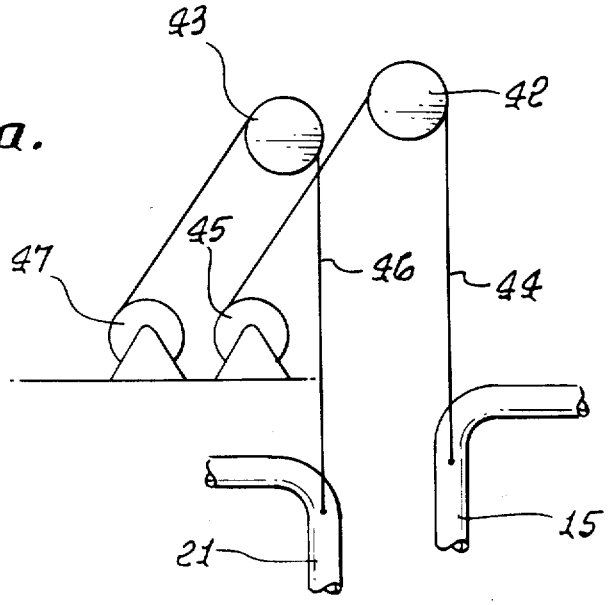
Figure 3:
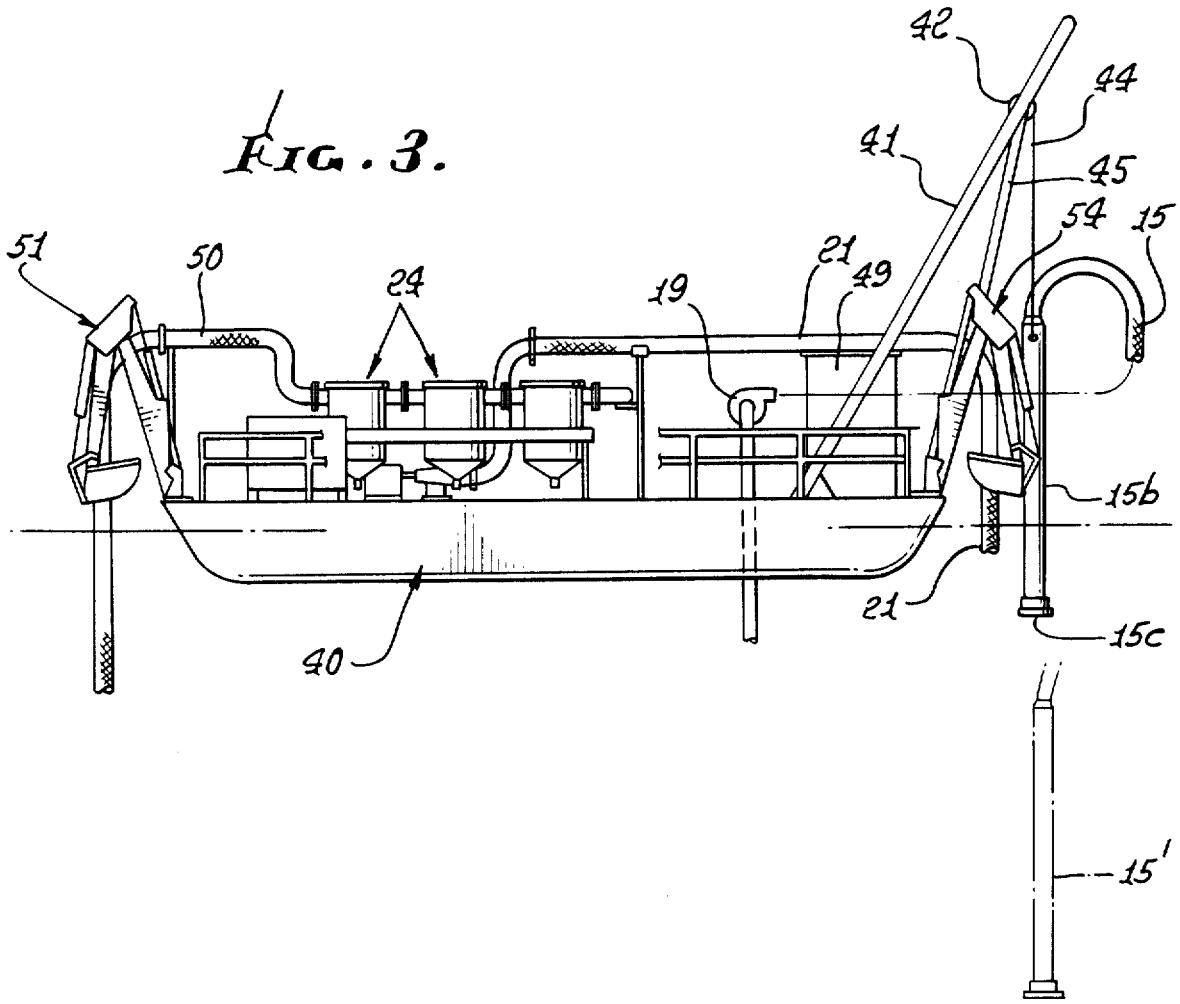
Figure 4:
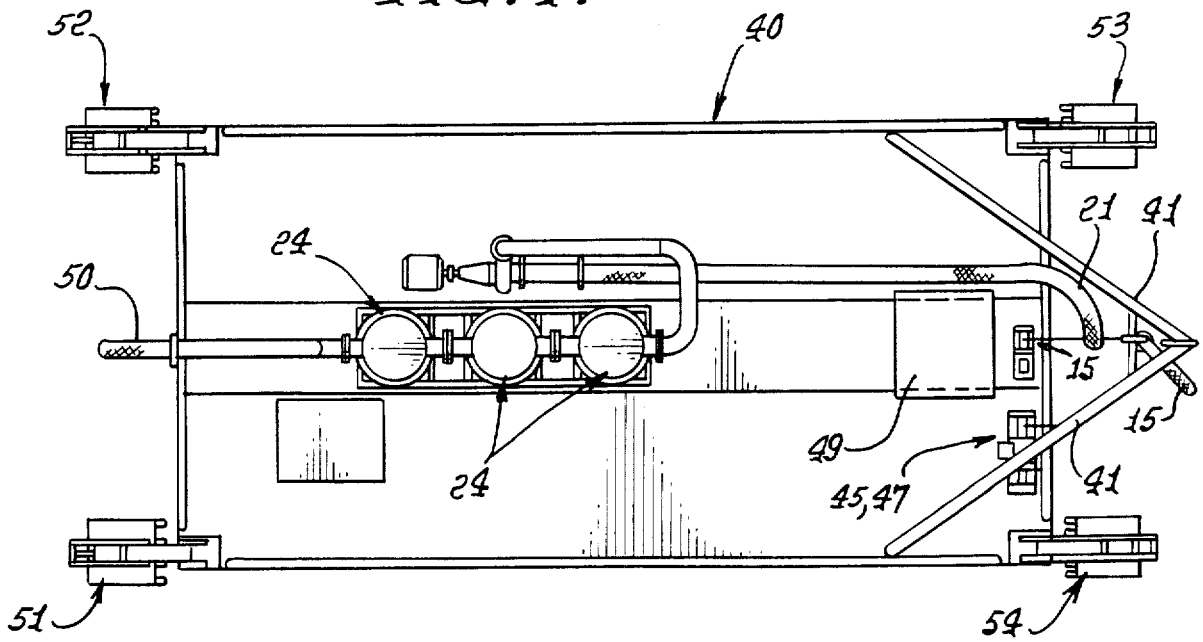

FIG. 2*a* is a schematic view of duct raising and lowering mechanism;

FIG. 3 is a side elevation of the FIG. 2 vehicle:

FIG. 4 is a top plan view of the FIG. 2 vehicle.

DETAILED DESCRIPTION

Figure 1:
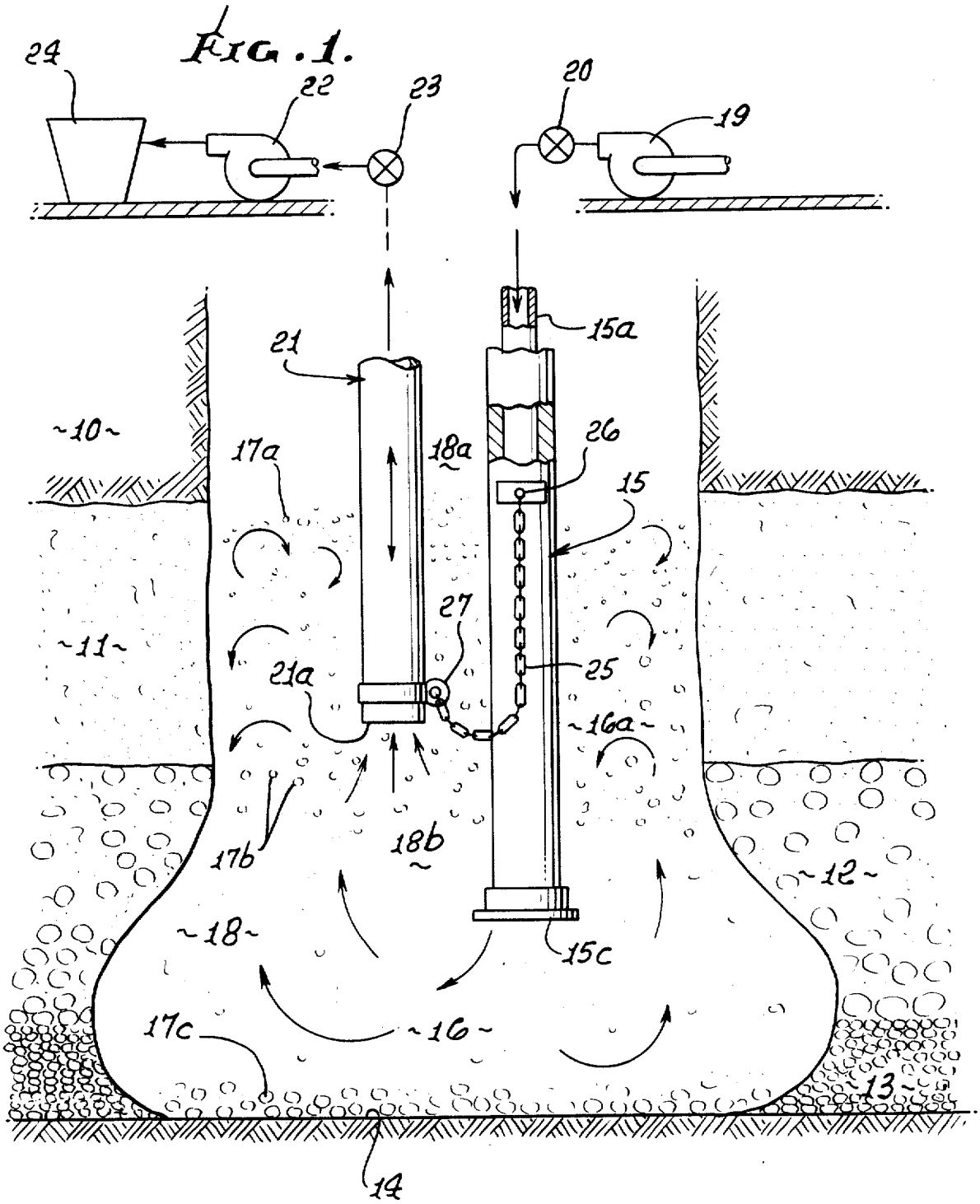
FIG. 1 is an elevation showing one preferred form of the invention.

Reference is first made to FIG. 1 showing a sub-surface formation in section, and from which metallic particles (as for example precious metals such as gold, etc.) are to be recovered. Such terrain may typically include a rich soil layer 10, a layer 11 of soil, sand and gravel beneath layer 10, a layer 12 of heavier rocks, soil, sand and slit beneath layer 11, and a somewhat porous layer 13, as for example a layer of relatively heavy rocks beneath layer 12. A bedrock layer 14 may directly underlie the porous zone 13. Such formations are typically found in California and other areas, where gold particles have become naturally deposited in the porous layer 13 just above bedrock level, as for example from streams flowing downstream from a "mother lode" of gold ore. The recovery of the gold particles from zone 13, or similar underground porous zones, without dredging, and with minimum disturbance to the terrain, has presented a very substantial problem.

Referring in more detail to FIG. 1, a first duct 15 is provided to extend downwardly to terminate at or near a locality 16. That duct may include intercoupled pipe lengths 15*a*, and a heavy hydraulic collar 15*b* attached to the lowermost pipe length. Duct 15 is operable to deliver water in a pressurized stream to locality 16 via a duct discharge 15*c*, for effecting differential elevation of metallic and non-metallic particles in a turbulent water zone 16*a* associated with locality 16 and the duct discharge. See for example the lighter or fine particles 17*a* "boiling" upwardly in the upper region 18*a* of pit or "bell hole" 18, and heavier particles 17*b* falling back downwardly in a lower region 18*b* of the pit or belt hole. The heaviest "particles" such as smaller and larger rocks 17*c* never rise far above the bottom of the hole. The smaller fines in region 17*a* are non-metallic for the most part, whereas the heavier fines, which include prescious metal particles tend to concentrate at 17*b* in zone 18*b*. However, the elevation of zone 18*b* relative to the discharge 15*c* and the bedrock layer 14 is not known, as it will vary with the shape of the bell hole, the degree of water and particle turbulence in the bell hole, and the rate of water discharge via duct 15 into the bell hole. Note water delivery pump 19 and control valve 20 at the surface, the water pressure acting to hydraulically form and enlarge the bell hole, and to produce the turbulence therein.

In accordance with an important aspect of the invention, a second duct 21 is provided to extend downwardly into or proximate the bell hole. That duct has an intake 21*a* positioned in the turbulent zone 16*a*, for drawing water and metallic particles from therein into and upwardly in the second duct. Note for example suction pump 22 via which water and particles are drawn upwardly and through control valve 23. The pump discharge passes to a separator 24 which may comprise a cyclone.

The intake 21*a* is accurately positioned or positionablein the turbulent region 18*b* wherein the metallic particles concentrate, i.e. fall back after being levitated by the turbulence. To promote or optimize this positioning, for richest recovery of precious metal particles, means is typically provided for adjusting the elevation of the intake 21*a* relative to that of discharge 15*c*. Such means may with unusual advantage comprise a lower connection, such as a flexible connector in the form of a chain 25 (or cable) interconnecting the two ducts 21 and 15. As shown, one end of the chain is connected at 26 to duct 15, and at 27 to duct 21. This allows duct 21 to be raised or lowered to limited extent relative to duct 15 while remaining connected to the latter so as to be lowered therewith and raised therewith, as by a cable and winch system seen at 15' or other means, simplifying the operation.

In addition, as the heavy hydraulic collar 15 is moved laterally or horizontally, to scavenge different areas of the hole, or to enlarge same, the duct 21 is carried along with it due to the chain connection.

In operation, the pressurized water delivery via duct 15 may be controlled to be continuous, or reduced (as for example interrupted, at intervals).

In such event, the metallic fines tend to drop down in the turbulent zone during interrupted pressure delivery, and tend to rise during resumed pressure delivery. They can thereby be caused to pass back and forth through zone 18*b*, for pick-up by the intake 21*a* during continuous operation of the pump 22. This "huff and puff" method of operation can be carried out with or without raising and lowering of the intake, as described, all for the purpose of maximizing precious metal fines recovery, through concentration of fines in a turbulent zone and pick-up thereof by adjustment of the location of intake 21*a* relative to the fines concentration.

In operation, the mineral values which are gold and platinum make up only a tiny fraction of 1% of the fines (metallic and non-metallic) to be handled; however, black sand with a specific gravity of 7.85 is normally present in placer ground material, and quartz fines have a specific gravity of 2.35. Other rock fragments lighter than quartz have specific gravity of about 2.0. The specific gravities of gold and platinum are 19.4 and 20.5, respectively.

Operation of the "huff and puff" system effects high pressure washing of the rocks and soil to create the described bell hole or recovery zone, which can be "huffed and puffed" as long as mineral recovery samples remain to be recovered. The delivery pump 19 may typically have a 4,000 gallon per minute capability; the suction pump typically has about 2,000 gpm capability; and the bell hole may be quickly formed (in less than one hour), using a 5,000 lb. hydraulic collar 15*b*.

FIGS. 2–4 show a carrier vehicle such as barge 40 from which ducts 15 and 21 are controllably suspended as via a boom 41 carrying pulleys 42 and 43. Cable 44 from control winch 45 suspends duct 15; and cable 46 from control winch 47 elevates and lowers the suction duct 21. As the boom is raised and lowered, both ducts are raised and lowered together. A control cabin appears at 49, and separator cyclones at 24. The latter discharge water via duct 50 for return to the water body. Back hoes 51–54 are carried at the corners of the barge, and are operable to move the barge over terrain, as disclosed in my U.S. Pat. No. 3,855,807.

The method of operation basically involves the steps:

(a) delivering water in a pressurized stream to said locality via the first duct discharge to effect differential elevation of metallic and non-metallic particles in a turbulent water zone associated with said discharge, (b) and positioning the intake of said second duct for drawing water and metallic particles from said zone into said second duct.

Further, the method typically includes allowing the first duct to penetrate downwardly into said formation while hydraulically forming a pit therein and maintaining a loose connection between the lower portion of the ducts so that the intake of the second duct is captivated to remain at an adjustable position within a predetermined zone associated with the discharge end of the first duct, within the pit.

I claim:

1. Apparatus for recovering metallic particles in a formation at a sub-surface locality, comprising (a) a first downwardly extending duct having a discharge and operable to deliver water in a pressurized stream to said locality via said discharge for effecting differential elevation of metallic and non-metallic particles in a turbulent water zone associate with said discharge, and (b) a second downwardly extending duct having an intake positioned in said zone for drawing water and metallic particles from said zone into said second duct, (c) a loose flexible interconnection between said ducts accomodating second duct movement in its entirety up and down relative to the first duct and relative movement of the ducts toward and away from one another, as well as positioning of the second duct intake above the level of the first duct discharge, (d) means for adjusting the position of the intake of the second duct relative to the discharge of the first duct, (e) and a carrier vehicle movable over terrain and water and suspending said ducts.

2. The apparatus of claim 1 wherein said loose interconnection comprises a chain, or flexible cable, or the like.

3. The apparatus of claim 2 wherein said first duct includes a metallic hydraulic collar to which said second duct is loosely interconnected.

4. The apparatus of claim 1 including a suction pump connected with the second duct to withdraw metallic particles and water, as well as non-metallic particles, upwardly to a separation zone.

5. The apparatus of claim 4 including a separator at said zone.

6. The apparatus of claim 1 wherein said adjusting means (including) includes structure on the vehicle and connected with the second duct to move it up and down relative to the first duct.

7. Apparatus of claim 1 wherein the two ducts extend downwardly to terminate in a pit formed in the formation by hydraulic penetration of water discharged from the first duct, the turbulent water zone located in said pit.

8. Apparatus of claim 7 wherein the pit has the shape of bell hole, the intake of the second duct located at a higher elevation in the bell hole than the discharge of the first duct.

* * * * *